US005881808A

United States Patent [19]

Rehbock et al.

[11] Patent Number: 5,881,808

[45] Date of Patent: Mar. 16, 1999

[54] WINDOW-CUTTING SYSTEM FOR DOWNHOLE TUBULARS

[75] Inventors: Hans H. Rehbock; John J. Johnson, both of Houston, Tex.

[73] Assignee: Baker Hughes Incorporated, Houston, Tex.

[21] Appl. No.: 916,003

[22] Filed: Aug. 21, 1997

Related U.S. Application Data

[63] Continuation of Ser. No. 528,091, Sep. 14, 1995, Pat. No. 5,676,206.

[51] Int. Cl.[6] ..... E21B 7/08

[52] U.S. Cl. ..... 166/117.5; 166/117.6

[58] Field of Search ..... 166/117.6, 117.5, 166/55.7; 175/81, 79, 82, 61, 73

[56] References Cited

U.S. PATENT DOCUMENTS 5,109,924 5/1992 Jurgens et al. .

5,301,760 4/1994 Graham .

5,341,873 8/1994 Carter et al. .

5,566,762 10/1996 Braddick et al. .

5,595,247 1/1997 Braddick ..... 166/117.6 X

OTHER PUBLICATIONS

Christensen Catalog, The Whirlbuster from Hughes Christensen, AR Series Anti–Whirl PDC Bits, 1992.

*Primary Examiner*—Frank S. Tsay

*Attorney, Agent, or Firm*—Rosenblatt & Redano P.C.

[57] ABSTRACT

A guide lug for a starting or window mill is provided at the upper end of the whipstock. A back-up shoulder is provided to act against any tendencies of the mill to whirl. A taper is provided for use in guiding the mill toward the casing for the cutting of the window. The lug is configured to be worn by a guide for the window mill or starter mill rather than being milled away. As a result of the use of the lug, the upper sections of the whipstock are protected from the mill. In turn, any holes or other projections provided for subsequent retrieval of the whipstock are functional for such a retrieval at the conclusion of the milling process for the window.

6 Claims, 3 Drawing Sheets

WINDOW-CUTTING SYSTEM FOR DOWNHOLE TUBULARS

RELATED PATENT APPLICATION

This application is a continuation of Ser. No. 08/528,091 filed on Sep. 14, 1995, now U.S. Pat. No. 5,676,206.

FIELD OF THE INVENTION

The field of this invention relates to milling a window in casing and more particularly to guiding systems for mills to accomplish the cutting of a window.

BACKGROUND OF THE INVENTION

In the past, window-cutting systems have involved the use of whipstocks and multiple trips with a starter mill and a window mill coming in behind it to cut out a window. Until recently, there has been no emphasis placed on retrievability of the whipstock in that the older designs and applications presuppose that the whipstock would remain in the wellbore after the window was milled.

More recently, the concept of retrievability of whipstocks has been introduced for a variety of applications. In some instances, the liner which is inserted through the window is cemented all the way back into the main wellbore. Thereafter, milling is required to remove the section of liner extending into the main wellbore. This procedure is illustrated in U.S. Pat. No. 5,301,760. Various attempts in the past have been made to retrieve whipstocks. One such tool is illustrated in U.S. Pat. No. 5,341,873, assigned to Weatherford. These retrieving techniques employed in the past generally required that the structural integrity of the upper end of the whipstock be maintained so that the retrieving tool could get a firm grip on the whipstock to ensure its removal.

Milling techniques have also improved so that a one-trip system can be employed to create the window. U.S. Pat. No. 5,109,924 illustrates a one-trip window-milling system where a started mill is followed by one or more watermelon mills. The assembly is initially retained to the whipstock by a lug and a shear pin.

FIG. 1 illustrates a lug of the type previously employed, with standard multi-trip window-milling systems as well as a one-trip system such as illustrated in Jurgens.

The initial contact wearing surface 10 was previously held at approximately an angle of 2–5° as represented by "a" in FIG. 1. The starter mill 12 had a guide section 14 which was designed to contact the lug 16. In view of the speed of rotation of the starter mill 12 and the small angle "a" employed, the wear patterns on lug 16 were such that it would be quickly ground away before the starter mill 12 could get much of a bite into the casing 18. When this occurred, the mill would be driven away from the casing 18 so that it would retract from an initial window which had just started to open as the mill 12 is further advanced downwardly. If this was allowed to occur, eventually the starting mill 12 ground away the top of the whipstock 20 to a point represented by dashed line 22. This technique was somewhat hit or miss and frequently resulted in severe damage to the top of the whipstock 20. Such damage was generally sufficiently extensive to prevent or at least make extremely difficult any attempt to recover the whipstock 20 from the wellbore. This is because holes conveniently placed near the top of the whipstock for retrieval purposes would be one of the first things ground up if the blades of the starting mill 12 were allowed to progress into contact with the whipstock 20.

The shortcomings of the prior designs were due to the lug design and an effect called "whirl," which is best illustrated in FIG. 2. FIG. 2 schematically illustrates in a plan view a casing 18, along with a starter mill 12, which has a series of blades 24 thereon. The blades are designed to create the cutting action when engaged against the casing 18 due to a clockwise rotation of the starter mill 12, as illustrated by arrow 26. However, since the mill 12 is itself smaller than the opening in which it is disposed, the clockwise rotation imparted to the starter mill 12 as indicated by arrow 26 results in the entire mill 12 rotating in a counterclockwise manner illustrated by arrow 28 within its surroundings. Since the initial surroundings about the starting mill 12 are larger than the O.D. of the mill, the whirl effect creates contact between the blades 24 and the casing 18 such that an undesirable force in the direction of arrow 30 is applied to each of the blades as the starter mill 12 whirls in a counterclockwise direction indicated by arrow 28. In the past, this whirl effect has resulted in severe damage to the starter mill 12 and in many cases to the whipstock 20. The whirl action further exacerbated the wearing away of the lug 16.

While in past designs the objective of beginning a window may have been accomplished, this achievement was at the cost of near complete destruction of the starter mill 12 as well as sufficient damage to the top end of the whipstock 20 to eliminate or at least make difficult subsequent attempts to retrieve it.

One of the many objectives of this invention is to provide guidance and stabilization to the mill or mills through the use of the configuration of the lug to remove the effect of whirl and to spare the whipstock from damage during the process of milling the window in the casing 18. To that end, a sacrificial lug including an initial contact taper and a back-up shoulder has been developed. The taper allows applied weight on the mill during the window milling to more directly orient the mill toward the casing where the window is to be cut. Greater torque control is possible due to the improved guidance of the mill or mills which reduces stall-outs when the mill gets stuck. The lug configuration is directed to the objective of providing a wearing surface rather than a surface that is milled during the creation of the window. Yet another objective is to preserve any retrieving slots or other protrusions used for subsequent retrieval of the whipstock by ensuring that the mill or mills do not destroy such features during the window-milling process.

SUMMARY OF THE INVENTION

A guide lug for a starting or window mill is provided at the upper end of the whipstock. A back-up shoulder is provided to act against any tendencies of the mill to whirl. A taper is provided for use in guiding the mill toward the casing for the cutting of the window. The lug is configured to be worn by a guide for the window mill or starter mill rather than being milled away. As a result of the use of the lug, the upper sections of the whipstock are protected from the mill. In turn, any holes or other projections provided for subsequent retrieval of the whipstock are functional for such a retrieval at the conclusion of the milling process for the window.

DETAILED DESCRIPTION OF THE PREFERRED EMBODIMENT

Figure 1:
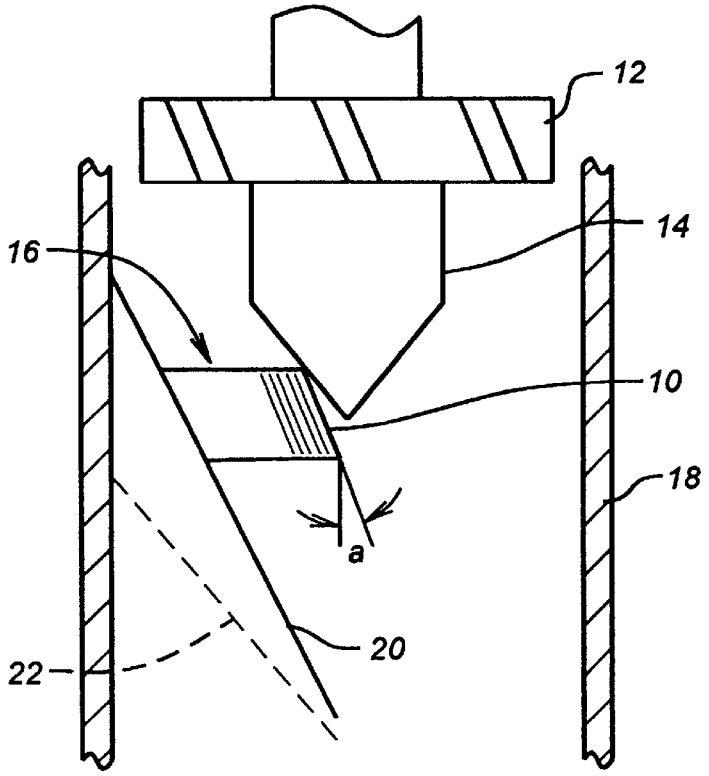
(PRIOR ART) FIG. 1
FIG. 1 is a sectional elevational view of the prior art lug used in conjunction with a whipstock and a starting mill.
Figure 2:
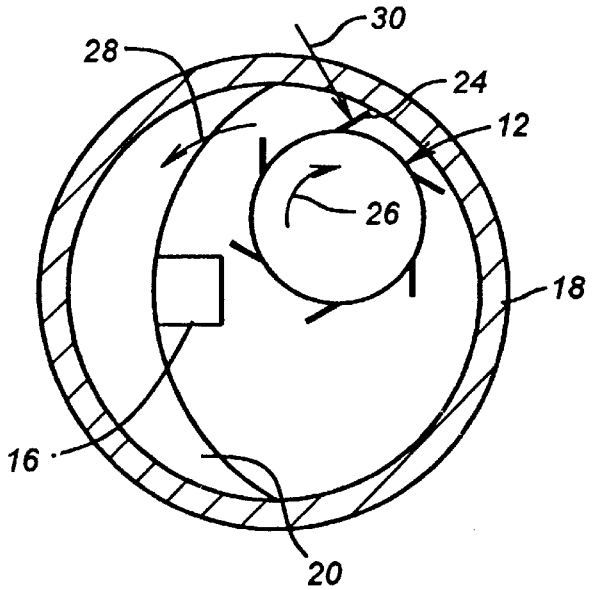
(PRIOR ART) FIG. 2
FIG. 2 is a schematic representation of the effect of whirl in prior designs of lugs for milling tools used in conjunction with whipstocks.
Figure 3:
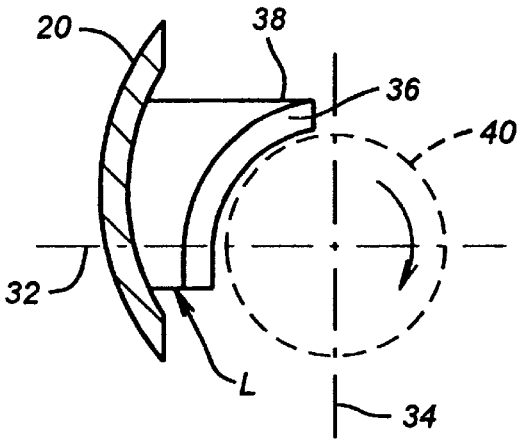
FIG. 3 is a plan view showing the lug of the present invention.
Figure 4:
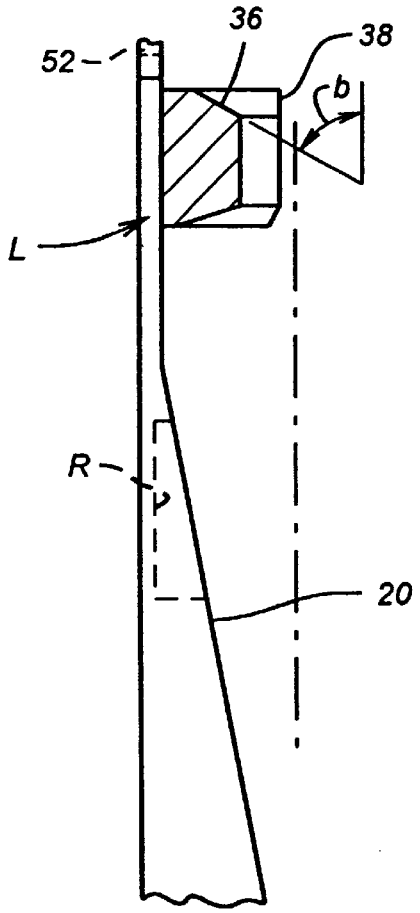
FIG. 4 is an elevational view of the lug illustrated in FIG. 3.
Figure 5:
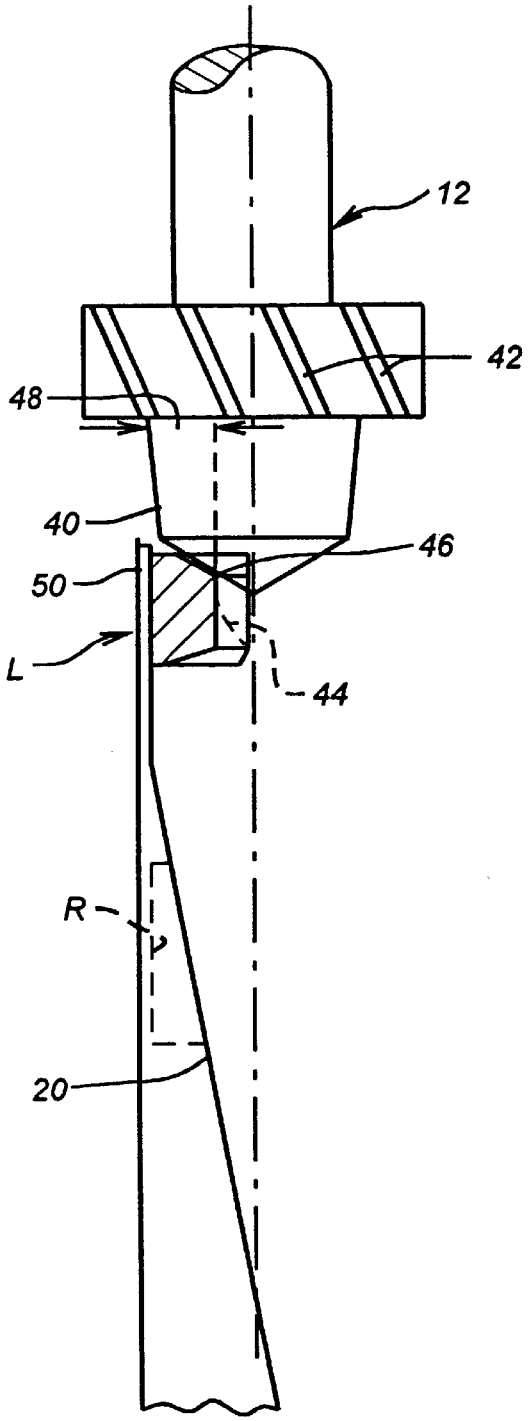
FIG. 5 is an illustration of a conventional or coiled tubing-supported starter mill on the lug of the present invention shown in sectional elevational view.

FIG. 3 illustrates a plan view of the lug L of the present invention. For clarity, the casing 18 is eliminated. A standard whipstock 20 can be used with the lug L, as shown in FIG. 3. Lug L is preferably made from a bronze-aluminum alloy to facilitate the welded connection to the whipstock 20, which is preferred. However, other soft or wearable material, such as brass or bronze, can be used without departing from the spirit of the invention. The orientation of the mill, with respect to the lug L, is indicated by the centerlines 32 and 34. Adjacent the top of lug L is a tapered surface 36 sloping downwardly toward centerlines 32 and 34. Tapered surface 36 wraps around such that a back-up shoulder 38 is formed as part of the lug L. It further acts as a guide surface for such items as guide 40 for the milling of a window. Taper 36 is preferably at an angle of >5° to <90° from the vertical, as illustrated by angle "b" of FIG. 4. While some improvement over the prior art designs is measured at angles "b" of as little as >5°, significant improvement in the performance of the mill such as 12 is achieved when the taper angle is about 30° or more to about <90°. The back-up shoulder 38 eliminates the tendency of mill such as 12 to whirl. A portion of the guide 40 (see FIG. 5) is illustrated in dashed lines in FIG. 3. An arrow in FIG. 3 illustrates the clockwise rotation of guide 40 which turns with the mill such as 12 from rigid tubing extending to the surface or from a downhole motor such as in a coiled tubing application. The clockwise driving of the mill such as 12 tends to create an opposing turning motion on the mill itself in a counterclockwise direction since it is in an area of the casing where there is room around the mill for it to whirl in the absence of a shoulder 38. The back-up shoulder 38 creates a smaller space around the mill as it begins to cut into the casing and firmly supports the mill 12 or, in the position shown in FIG. 3, the guide 40, against a tendency to whirl in a counterclockwise direction. The sloping surface 36 can be used to provide a horizontal component to the guide 40 so that the mill cutters 42 can be directed with the horizontal component toward the casing wall opposite the whipstock 20. Many combinations of downward weights applied to the mill 12 with the taper angle 36 allow for better control of the milling process. The mill is less likely to advance overly rapidly to a jamming position between the casing that has not yet been cut and the whipstock. The use of angles >5° also result in a gradual erosion or wearing down of the lug L as the mill 12 advances. Dashed line 44 in FIG. 5 indicates how much of the lug L is worn away during normal operation.

It is desirable to configure the lug 40 so that the transverse dimension from the initial point of contact, shown schematically as 46, with the lug L to the outer periphery of the guide 40 should exceed the thickness of the casing to be milled. Stated differently, dimension represented between the arrows 48 should exceed the thickness of the casing to be milled. The dimension 48 represents the amount of expected horizontal movement of the guide 40 as the wear pattern illustrated by dashed line 44 is accomplished during the milling operation. It should be noted that the window-milling operation using the lug L as above described allows for successful lateral deflection of the guide 40 away from the whipstock 20 and toward the casing 18 (omitted from FIG. 5 for clarity).

The operator at the surface curtails the milling operation with the mill 12 has advanced a predetermined amount. That amount is a distance generally about 3 feet which is sufficiently smaller than the initial gap between the cutters 42 and the top end 50 of the whipstock 20. An opening such as 52 can effectively be used after milling for a retrieval operation with known "fishing" tools such as shown in U.S. Pat. No. 5,341,873. Such openings 52 or similar features to facilitate retrieval are preserved and not milled over as with prior designs.

A lug L of the same design is adaptable for use in one-trip milling systems such as those described in U.S. Pat. No. 5,109,924. There, the lug L is secured in the same manner as previously described except that it conforms to a groove 52 above the window mill 54 (see FIG. 6). In the preferred embodiment, there is a slight clearance between the groove 52 and the vertically oriented surface 56 which arcs around groove 52 to obtain the desirable results described above. Just as in the embodiment of FIG. 5, which illustrates conventional or coiled tubing-supported starting mills such as 12, the lug L is worn away as the window mill 54 progresses, all the while helping surface personnel to achieve a horizontal component force to direct the window mill 54 away from the whipstock 20 while at the same time eliminating its desire to whirl due to the provision of the back-up shoulder, such as 38' previously described. It should be noted that to accommodate the one-trip system as described in the Jurgens patent No. 5,109,924, special features can be provided into the whipstock 20 without departing from the spirit of the invention.

As a result of using the lug L of the present invention, several desirable features are achieved over prior art lug support systems. The cutters on the mills used are stabilized against the tendency to whirl. This provides a greater stability to the mill and a more reliable window cut. It also acts to protect the top of the whipstock which can be severely damaged from the whirling effect. Accordingly, openings or protrusions or other devices used for subsequent recovery of the whipstock are not destroyed by the whirling mill as had occurred with prior designs. Window or starter mills are less likely to stall out due to jamming because a greater torque control is possible using the taper feature of the lug, as described above. Typically, with an application of 500–3000 lbs. weight on the mill during the window-milling operation, a sufficient horizontal component is created to initiate the window and reduce jamming of the mill, such as between the casing and the whipstock, which had occurred in old designs with the lug milled away. Instead, with the lug L of the present invention, the gradual planned for wearing, as indicated by dashed line 44, provides control throughout the window-cutting procedure and predictability of where the window will be cut. The problem of prior designs with the mill receding from an initial window when the lug was milled away is eliminated by the lug L of the present design. Similarly, with the back-up shoulder 38, the tendency to create a misaligned casing window with respect to the whipstock face, also known in the art as "dog leg severity," is further eliminated due to the stabilizing effect on the mill from the design of the lug L. Additionally, the whipstock can now be easily retrieved with confidence since the features for retrieving, such as slots or weldments, are preserved rather than being ground off with the lug, as in many of the past designs.

Figure 6:
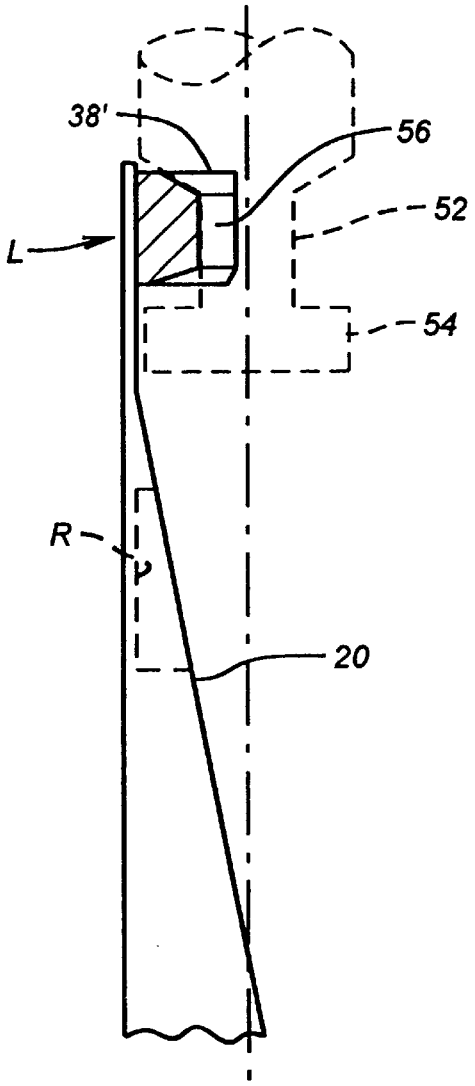
FIG. 6 is a sectional elevational view of the lug of the present invention showing its use in a one-trip milling system such as that illustrated in U.S. Pat. No. 5,109,924.

The lug L of the present design can be used with conventional window-cutting systems to improve performance. The lug L is even more important to coiled tubing applications for better control of the mill and for elimination of stall-outs. As shown in FIG. 6, the lug L of the present invention has application in one-trip milling systems where, although the lug is positioned behind the mill 54, its principle of operation and the benefits derived are the same as those for conventional or coiled tubing-supported mills described in FIG. 5.

The lug L is simple to produce and secure by the preferred method of welding to a whipstock 20. Despite its economical construction, it returns significant benefits in preservation of the integrity of the equipment, such as the whipstock 20, as well as saving rig time in fishing by facilitating the integrity of retrieval features at the top of the whipstock.

The foregoing disclosure and description of the invention are illustrative and explanatory thereof, and various changes in the size, shape and materials, as well as in the details of the illustrated construction, may be made without departing from the spirit of the invention.

We claim:

1. A whipstock support system for cutting a window in a downhole tubular such as a casing using at least one mill, having a guide thereon, said guide having a peripheral surface, comprising:

a whipstock;

a lug on said whipstock having a tapered contact surface for contact with at least a point on the guide on the mill, said lug having a vertical axis and said taper formed to be at an angle of between 5° and 90° from said vertical axis.

2. The system of claim 1, wherein:

said angle of said taper is about 30° from said vertical axis.

3. The system of claim 1, wherein:

said tapered surface is configured so that the radial distance from the point of initial contact of the guide of the mill with said tapered surface to the periphery of the guide exceeds the thickness of the casing to be milled.

4. The system of claim 1, further comprising:

a retrieval device mounted to said whipstock;

said retrieval device remaining functional throughout the process of milling the window.

5. The system of claim 1, wherein:

said lug, due to said tapered surface, is worn away as the guide of the mill advances in a manner that creates a force on the mill toward the casing for forming the window.

6. The system of claim 5, wherein:

said lug guides the mill to make the entire window before the mill can contact said lug or said whipstock.

* * * * *